US008043446B2

(12) United States Patent
Jung et al.

(10) Patent No.: US 8,043,446 B2
(45) Date of Patent: Oct. 25, 2011

(54) HIGH MANGANESE DUPLEX STAINLESS STEEL HAVING SUPERIOR HOT WORKABILITIES AND METHOD MANUFACTURING THEREOF

(75) Inventors: Jae-Young Jung, Pohang-si (KR); Bong-Year Ma, Pohang-si (KR)

(73) Assignee: Research Institute of Industrial Science and Technology (KR)

( * ) Notice: Subject to any disclaimer, the term of this patent is extended or adjusted under 35 U.S.C. 154(b) by 0 days.

(21) Appl. No.: 10/398,128

(22) PCT Filed: Apr. 26, 2002

(86) PCT No.: PCT/KR02/00786

§ 371 (c)(1), (2), (4) Date: Mar. 31, 2003

(87) PCT Pub. No.: WO02/088411

PCT Pub. Date: Nov. 7, 2002

(65) Prior Publication Data

US 2004/0050463 A1 Mar. 18, 2004

(30) Foreign Application Priority Data

Apr. 27, 2001 (KR) ..... 2001-23111
Apr. 27, 2001 (KR) ..... 2001-23112

(51) Int. Cl.
*C21D 6/02* (2006.01)
*C22C 38/58* (2006.01)

(52) U.S. Cl. ..... 148/608; 148/327; 420/57

(58) Field of Classification Search ..... 148/325, 148/327, 608; 420/46, 47, 57, 59.57
See application file for complete search history.

(56) References Cited

U.S. PATENT DOCUMENTS 4,101,347 A 7/1978 Fujikura et al.
4,272,305 A 6/1981 Weingerl et al.
(Continued)

FOREIGN PATENT DOCUMENTS

EP 0683241 A2 * 11/1995
(Continued)

OTHER PUBLICATIONS

Davis et al., The ASM Handbook, Aug. 1991, vol. 4, pp. 91-92.*
(Continued)

*Primary Examiner* — Jessee R. Roe
(74) *Attorney, Agent, or Firm* — The Webb Law Frim

(57) ABSTRACT

A high manganese duplex stainless steel with excellent hot workability, comprising (in weight %): less than 0.1% of C; 0.05-2.2% of Si; 2.1-7.8% of Mn; 20-29% of Cr; 3.0-9.5% of Ni; 0.08-0.5% of N; less than 5.0% of Mo and 1.2-8% of W, alone or composite; the balance Fe and inevitable impurities; and a method for manufacturing the duplex stainless steel, comprising the steps of: solution heating the duplex stainless steel composition at a temperature of 1,050 to 1,250° C., hot working at a starting temperature of 1,130 to 1,280° C. and then ending at a temperature greater than 1,000° C., and then cooling within the temperature range from 1,000 to 700° C. at a cooling rate of more than 3° C./min. The duplex stainless steel exhibits a reduction in area of more than 50% at 1,050° C., and possesses a yield strength of more than 400 MPa, and a corrosion rate of less than 0.36 mm/year, after solution heating.

15 Claims, 4 Drawing Sheets

U.S. PATENT DOCUMENTS

| | | | | | |
|---|---|---|---|---|---|
| 4,657,606 | A | | 4/1987 | Guha | |
| 4,664,725 | A | | 5/1987 | Fujiwara et al. | |
| 4,721,600 | A | * | 1/1988 | Maehara et al. | 420/57 |
| 4,765,953 | A | | 8/1988 | Hagenfeldt et al. | |
| 4,828,630 | A | | 5/1989 | Daniels et al. | |
| 5,298,093 | A | | 3/1994 | Okamoto | |
| 5,303,766 | A | * | 4/1994 | Kreijger et al. | 164/476 |
| 5,582,656 | A | * | 12/1996 | Kangas et al. | 148/325 |
| 5,626,694 | A | * | 5/1997 | Kawabata et al. | 148/609 |
| 5,733,387 | A | | 3/1998 | Lee et al. | |
| 6,048,413 | A | | 4/2000 | Park et al. | |
| 6,174,386 | B1 | | 1/2001 | Delblanc-Bauer et al. | |
| 6,312,532 | B1 | | 11/2001 | Kangas | |

FOREIGN PATENT DOCUMENTS

| | | | | |
|---|---|---|---|---|
| GB | 2205857 | A | * | 12/1988 |
| JP | 61-23713 | A | | 2/1986 |
| JP | 03-082740 | | | 8/1991 |
| JP | 03-229839 | | | 11/1991 |
| JP | 08-013094 | | * | 1/1996 |
| JP | 09-031604 | A | | 2/1997 |
| JP | 09-316602 | | * | 9/1997 |
| JP | 9-302446 | A | | 11/1997 |
| JP | 2001-098344 | | * | 10/2001 |
| KR | 1994-3757 | B1 | | 2/1994 |
| WO | 99/13114 | A1 | | 3/1999 |
| WO | WO 01/00898 | A1 | | 1/2001 |

OTHER PUBLICATIONS

G.J. Adetunji, R.G. Faulkner and E.A. Little, "Quenching-rate determination for standard steel tensile specimens", J Mater Sci 26 (1991), pp. 1847-1850.*

Bogdanova, T.M. et al., "The Workability of Austenitic Manganese Steels During the Production of Hot Rolled Pipes", *Structure and Properties of Nonmagnetic Steels* (*Struktura i Svoystua Nemagnitnykh Steley*, 1982, pp. 185-190, Nauka, Moscow, USSR.

Lee, Soo-Chan et al., "Effects of Sulfur and Manganese on the Hot Workability of Austenitic Stainless Steels", *40th Mechanical Working and Steel Processing Conference*, 1998, pp. 959-966, Pittsburgh, Pennsylvania, USA.

Oh, B.W. et al., "The Influence of W on Corrosion Resistance and Sigma Phase Formation in Duplex Stainless Steels", *Innovation Stainless Steel*, 1993, pp. 3.59-3.64, Florence, Italy.

Kömi, J.I. et al., "Effects of Sulphur, Phosphorus and Cerium on the Hot Workability of a Ferritic-Austenitic Stainless Steel", *Proceedings of International Conference on Stainless Steels*, 1991, Chiba, ISIJ, pp. 807-814.

"Duplex Stainless Steels, Microstructure, Properties and Applications", 1997, 3 pp.; Robert N. Gunn, Ed.; Abington Publishing; Cambridge, England.

* cited by examiner

HIGH MANGANESE DUPLEX STAINLESS STEEL HAVING SUPERIOR HOT WORKABILITIES AND METHOD MANUFACTURING THEREOF

BACKGROUND OF THE INVENTION

1. Field of the Invention

The present invention relates to a duplex stainless steel useful for structural parts requiring strength and corrosion resistance, and more particularly, to a high manganese duplex stainless steel having excellent hot workability and a method for manufacturing the same.

2. Description of the Prior Art

Heretofore, duplex stainless steels have widely been used as basic materials in industrial equipment and structural parts requiring oxidation resistance and corrosion resistance. In particular, because 2205 type duplex stainless steels have higher corrosion resistance than austenite type stainless steels and are high in strength, they have been widely used in pipelines for chemical equipment, structural parts for dechlorination and desulfurization in power plants and the petrochemical industry, internal screw conveyors or bleaching reservoirs in the paper manufacturing industry, marine related equipment and the like. Recently, demands for duplex stainless steels have been increasing, because of the increase usages of dechlorination and desulfurization systems which are required in electric power stations or petrochemical equipment according to air pollution prevention policy. In addition to the above, these steels have been used as essential materials for air purification equipment in industrial waste incinerators.

Duplex stainless steels consist of a ferrite phase and an austenite phase, the ferrite phase improving strength and the austenite phase improving corrosion resistance. It is known in duplex stainless steels that pitting corrosion resistance and crevice corrosion resistance increase, resulting from the inclusion of Cr, Mo, W, and N in a basic Fe (R. N. Gunn, "Duplex Stainless Steels", Woodhead Publishing Ltd., (1997)). After duplex stainless steels are subjected to casting or solution heat treatment, if they are not cooled at an appropriate rate, precipitates containing large amounts of Mo or W, including mainly sigma phase, are formed within the temperature range of 700 to 950° C. Furthermore, α'-phase forming zone is within the temperature range of 300 to 350° C. Precipitates formed at high or medium temperature improve the hardness of duplex stainless steels. However, there are problems in that room-temperature ductility and impact toughness drastically deteriorate and corrosion resistance drops.

Typically, commercial Mo-containing duplex stainless steels have a basic chemical composition of Fe-(21-23 wt %)Cr-(4.5-6.5 wt %)Ni-(2.5-3.5 wt %)Mo-(0.08-0.20 wt %)N, and further contain less than 2.0% of Mn and less than 0.03% of C (UNS31803 or SAF 2205). There exist SAF 2507 type duplex stainless steels with superior corrosion resistance, resulting from increasing contents of Cr and Mo in the 2205 type duplex stainless steels. They have a basic chemical composition of Fe-(24-26 wt %)Cr-(6-8 wt %)Ni-(3-5 wt %)Mo-(0.24-0.32 wt %)N and further contain less than 1.2% of Mn and less than 0.03% of C.

U.S. Pat. No. 4,657,606 discloses duplex stainless steels having a basic chemical composition of Fe-(23-27 wt %) Cr-(4-7 wt %) Ni-(2-4 wt %) Mo-(less than 0.08 wt %) C. It has been reported that if the content of Cu is limited to 1.1-3.0% and the content of Mn increases up to 5-7%, after solution heating and then cooling, the rapid formation of sigma- or α'-phase is inhibited, thereby room-temperature ductility being enhanced. However, these types of steels are poor in hot workability.

Meanwhile, many techniques have attempted to increase the content of Mn, considering the fact that Mn improves room-temperature ductility and increases solid solubility of nitrogen by replacing expensive Ni. U.S. Pat. No. 4,272,305 discloses that the content of N is defined as high as 0.35-0.6% and the content of Mn is increased up to 4-6%, resulting in increasing solid solubility of nitrogen in a duplex stainless steel of Fe-(22-28 wt %) Cr-(3.5-5.5 wt %) Ni-(1-3 wt %) Mo-(less than 0.1 wt %) C. However, this type of steel has a disadvantage in that, due to high content of nitrogen, castability and hot workability deteriorate. And, in U.S. Pat. No. 4,828,630 discloses that the content of Mn is increased up to 4.25-5.5%, thereby replacing expensive Ni and increasing solid solubility of nitrogen in a duplex stainless steel of Fe-(17-21.5 wt %) Cr-(1-4 wt %) Ni-(less than 2 wt %) Mo-(less than 0.07 wt %) C. However, this sort of steel has a problem in that the lower limit of Ni is low, capable of adversely influencing corrosion resistance. Japanese Patent Laid-Open Publication No. 9-31604 discloses that the content of Si is maintained to be high (2.5-4.0%), and in order to increase solid solubility of nitrogen, the content of Mn is increased to be 3-7% in a Mo—W containing duplex stainless steel. However, this type of steel has a problem in that, due to the excess Si, impact toughness deteriorates. Accordingly, it is difficult for this type of steel to be commercialized.

Meanwhile, there have been some attempts to add Mn to a Fe—Cr—Ni type austenite stainless steel known as 304 or 316 type stainless steel, in order to replace expensive Ni. However, as the added amount of Mn increases, hot workability deteriorates and thus satisfactory results are not obtained. This fact was reported in T.M. Bogdanova et al., Structure and Properties of Nonmagnetic Steels, Moscow, USSR, pp. 185-190, (1982). But, it has been reported that as a result of including Mn and S in 316L, 309S, and 310S type stainless steels, if the content of Mn is lower, a re-precipitation or segregation of S is easier, thereby deteriorating hot workability (S.C. Lee et al., $40^{th}$ Mechanical Working and Steel Processing Conf., Pittsburgh, Pa., USA, pp. 959-966, (1998)).

Accordingly, in most commercial duplex stainless steels, to ensure hot workability, the content of Mn is limited to less than 2%. For example, U.S. Pat. No. 4,664,725 discloses that although hot workability is improved in a Ca/S ratio of greater than 1.5, the upper limit of Mn must be defined, since as addition of Mn increases, hot workability and corrosion resistance deteriorate.

As seen from the above, it is commonly regarded that as the content of Mn increases, hot workability deteriorates in duplex stainless steels. U.S. Pat. No. 4,101,347 proposes that the content of Mn should be limited to less than 2%, so as to prevent formation of sigma phase in the duplex stainless steel. This is supported by the fact that the content of Mn has been limited to less than 2% both in conventional Mo— or Mo—W containing duplex stainless steels.

Meanwhile, it is known that a Mo—W containing duplex stainless steel has an enhanced corrosion resistance. Therefore, recently, studies have been made on duplex stainless steels in which both Mo and W are added. For example, in a duplex stainless steel which was proposed by B. W. Oh et al., a part of Mo is replaced with W in a steel which contains less than 2.0% of Mn and 20-27% of Cr (Innovation of Stainless Steel, Florence, Italy, p. 359, (1993) or Korean Patent Application No. 94-3757). It is reported that a duplex stainless steel containing 1-4% of W and less than 1% of Mo has an improved corrosion resistance compared with that containing 2.78% of Mo. However, the above steel has an excessively low W and Mo content, and thus, the corrosion resistance is relatively decreased.

For another example, U.S. Pat. No. 5,298,093, filed by Sumitomo Metal Industries, Ltd., proposes that 2-4% of Mo and 1.5-5% of W are contained in a duplex stainless steel in which less than 1.5% of Mn and 23-27% of Cr are added. This steel is known to have high strength and excellent corrosion resistance. However, this steel is liable to crack during a hot rolling, and because it is a high-alloyed steel, the phase stability tends to be lowered, forming sigma phase, thereby deteriorating corrosion resistance and impact toughness. The W—Mo containing duplex stainless steel also has a problem in that hot workability is poor at the time of manufacturing finished product forms, including plate, wire, bar and pipe by hot working, similar to the above Mo-containing duplex stainless steel. As a result, a defective proportion of the products increases.

Similarly, U.S. Pat. No. 5,733,387 proposes that 1-2% of Mo and 2-5% of W are contained in a W—Mo containing duplex stainless steel in which less than 2.0% of Mn and 22-27% of Cr are added. However, this stainless steel still has little enhancement in hot workability, relative to the duplex stainless steel of U.S. Pat. No. 5,298,093.

In addition, U.S. Pat. No. 6,048,413 proposes a duplex stainless steel, in which less than 3.5% of Mn, 5.1-8% of Mo and less than 3% of W are contained. This steel is a high-alloyed duplex stainless steel and thus has the worst hot workability among the duplex stainless steels mentioned previously. Therefore, it is of limited utility for casting products. In addition, at the time of manufacturing products by casting, if cooling rate is slow (or if the size of a product is large), due to large quantities of Mo, formation of sigma phase is promoted, thereby deteriorating mechanical properties and corrosion resistance of the steel.

A conventional method for improving hot workability in duplex stainless steels involves adding Ce into the duplex stainless steels (J. L. Komi et al., Proc. of Int'l Conf. on Stainless Steel, ISIJ Tokyo, p 807, (1991) or U.S. Pat. No. 4,765,953). According to this method, the S content is lowered to 30 ppm, and Ce is added, so that the segregation of S is prevented, thereby improving the hot workability. However, in the case where hot workability is improved by adding rare earth elements such as Ce in large quantities, use of expensive Ce is unfavorable from an economic point of view. In addition to the above, the use of Ce has a problem in that strong oxidizing power of Ce causes clogging of nozzles upon continuous casting. As a result, the manufacture of billet or slab becomes hard. This duplex stainless steel does not contain W, but Mo.

SUMMARY OF THE INVENTION

Therefore, the present invention has been made in view of the above problems, and it is an object of the present invention to provide a duplex stainless steel with excellent strength, corrosion resistance, and castability, in particular, excellent hot workability, and a method for manufacturing the same.

In accordance with one aspect of the present invention, the above and other objects can be accomplished by the provision of a duplex stainless steel comprising (in weight %): less than 0.1% of C; 0.05-2.2% of Si; 2.1-7.8% of Mn; 20-29% of Cr; 3.0-9.5% of Ni; 0.08-0.5% of N; less than 5.0% of Mo and 1.2-8% of W, alone or composite; the balance Fe and inevitable impurities. The duplex stainless steel of the present invention is grouped into 4 classifications, according to the addition type of Mo and W.

First is a low chromium, Mo-containing duplex stainless steel, and comprising (in weight %): less than 0.1% of C; 0.05-2.2% of Si; 2.1-7.8% of Mn; 20-26% of Cr (except 26%); 4.1-8.8% of Ni; 0.08-0.345% of N; less than 5.0% of Mo; the balance Fe and inevitable impurities.

Second is a high chromium, Mo-containing duplex stainless steel, and comprising (in weight %): less than 0.1% of C; 0.05-2.2% of Si; 3.1-7.8% of Mn; 26-29% of Cr; 4.1-9.5% of Ni; 0.08-0.345% of N; less than 5.0% of Mo; the balance Fe and inevitable impurities.

Third is a W-containing duplex stainless steel, and comprising (in weight %): less than 0.1% of C; 0.05-2.2% of Si; 2.1-7.8% of Mn; 20-29% of Cr; 3.0-9.5% of Ni; 0.08-0.5% of N; 1.2-8% of W; the balance Fe and inevitable impurities.

Fourth is a Mo-W containing duplex stainless steel, and comprising (in weight %): less than 0.1% of C; 0.05-2.2% of Si; 2.1-7.8% of Mn; 20-27.8% of Cr; 3.0-9.5% of Ni; 0.08-0.5% of N; less than 5.0% of Mo; 1.2-8% of W; the balance Fe and inevitable impurities, the Mo and W contents meeting the conditions: Mo+0.5W=0.8-4.4%.

In accordance with another aspect of the present invention, there is provided a method for manufacturing the duplex stainless steel, comprising solution heating the duplex stainless steel composition mentioned above at, a temperature of 1,050 to 1,250° C.

In accordance with yet another aspect of the present invention, there is provided a method for manufacturing the duplex stainless steel, comprising the steps of: solution heating the duplex stainless steel composition mentioned above at a temperature of 1,050 to 1,250° C., hot working, which is initiated at a temperature of 1,130 to 1,280° C. and then terminated at a temperature of more than 1,000° C., and then cooling within the temperature range from 1,000 to 700° C. at a cooling rate of more than 3° C./min.

BRIEF DESCRIPTION OF THE DRAWINGS

The above and other objects, features and other advantages of the present invention will be more clearly understood from the following detailed description taken in conjunction with the accompanying drawings, in which:

FIG. 2(*b*) is a graph showing hot workability (reduction in area) according to the content of Mn, in the case where the content of Mo is constant;

FIG. 5(*b*) is a photograph showing the interior of the cast slabs of the inventive steel.

DETAILED DESCRIPTION OF THE PREFERRED EMBODIMENTS

The present inventors have discovered that if the content of Cu is limited to 0-1.0% and the content of Mn is increased, hot workability is improved. Based on this fact, they have found approaches for improving hot workability in Mn—Mo, Mn—W and Mn—Mo—W type duplex stainless steels and as a result, completed the present invention.

(1) Relation Between Mn and Hot Workability in Duplex Stainless Steel

U.S. Pat. No. 4,657,606 insured room-temperature ductility by adding 5-7% of Mn in a duplex stainless steel of (23-27 wt %)Cr-(4-7 wt %)Ni-(2-4 wt %)Mo-(1.1-3 wt %)Cu. However, there was no mention of how Mn influences hot workability (hot ductility). Generally, it is known that Mn adversely affects hot workability in duplex stainless steels.

Generally, room-temperature ductility and hot ductility are indicators of ductility and are similar with respect to the type of test used to determine each. However, as shown in Table 1, % reduction in area is a measure of hot ductility, while % elongation is a measure of room-temperature ductility, and thus they have different values.

TABLE 1

| Steel | Room-temperature ductility (elongation %) | Hot ductility (reduction in area, %: 1,050° C.) |
|---|---|---|
| Fe-(21-23 wt %)Cr-(4.5-6.5 wt %)Ni-(2.5-3.5 wt %)Mo-(0.08-0.20 wt %)N (SAF2205) | 30% | 41% |
| Pe-25 wt % Cr-7 wt % Ni-4 wt % Mo-1 wt % W-0.3 wt % N-1.5 wt % Si-1.5 wt % Mn | 6% | 58% |

In an attempt to improve hot workability of duplex stainless steels, the present inventors have discovered that Mn adversely affects hot workability in a high Mn-containing duplex stainless steel, in which more than 1.1% of Cu is added, while if the content of Cu is lowered to 0-1.0%, Mn enhances hot workability. Further, they focused on the fact that Mo and W affect properties of Mn.

(2) Hot Workability in a Mo-Containing (no W) Duplex Stainless Steel

Figure 1:
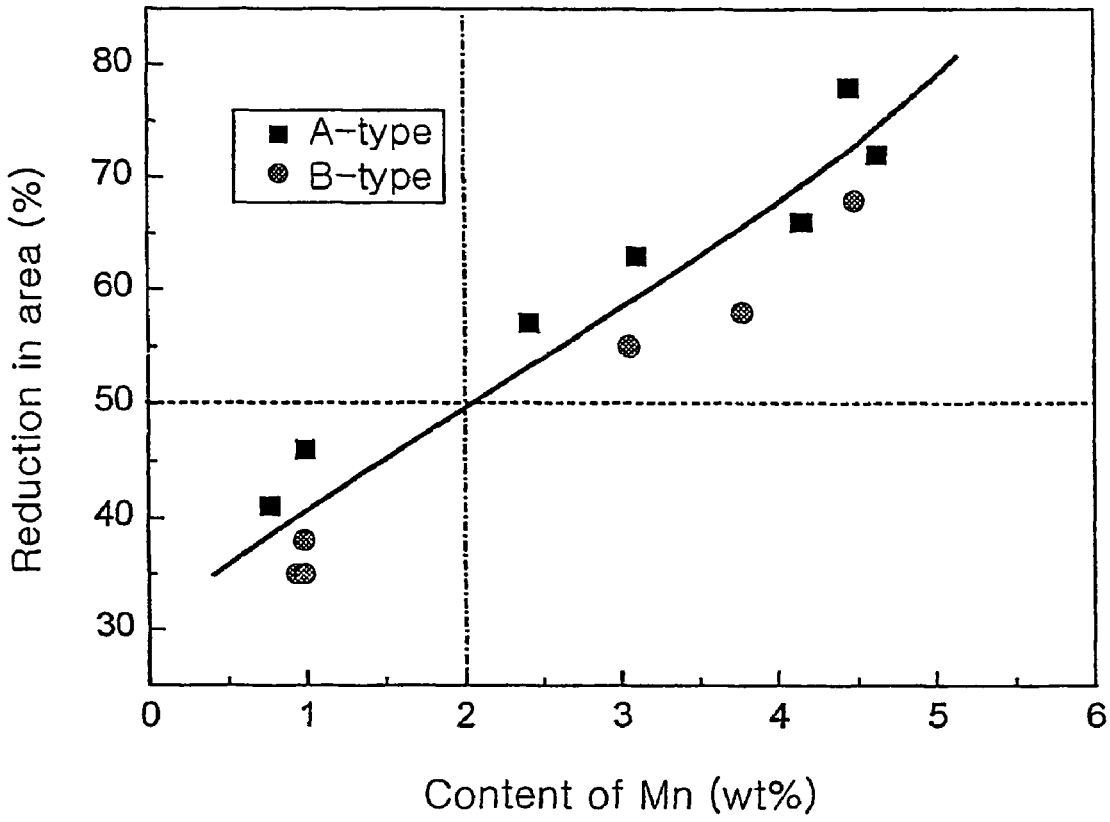
FIG. 1 is a graph showing hot workability (reduction in area) according to the content of Mn.

As shown in FIG. 1, as the added amount of Mn increases, hot workability (reduction in area) also increases, regardless of added amount of alloy and concentration of nitrogen. A-type, which is low in added amount of alloy and concentration of nitrogen, undergoes a greater reduction in area than B-type.

Figure 2A:
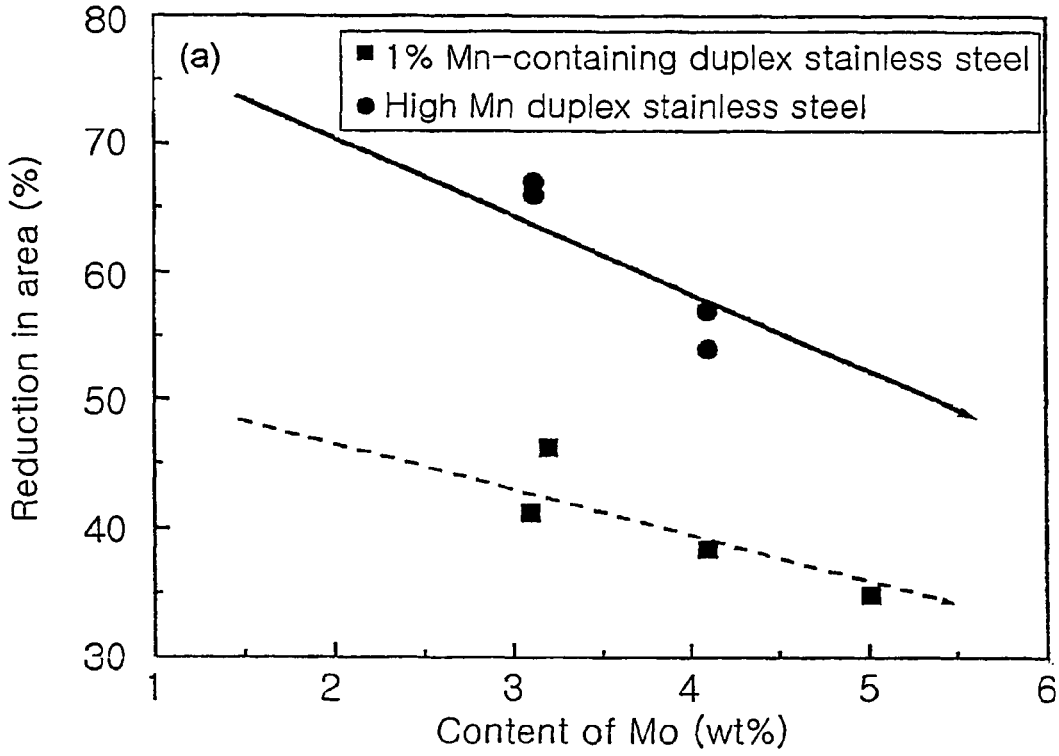
FIG. 2(*a*) is a graph showing hot workability (reduction in area) according to the content of Mo, in a low Mn-containing duplex stainless steel and a high Mn-containing duplex stainless steel.
Figure 2B:
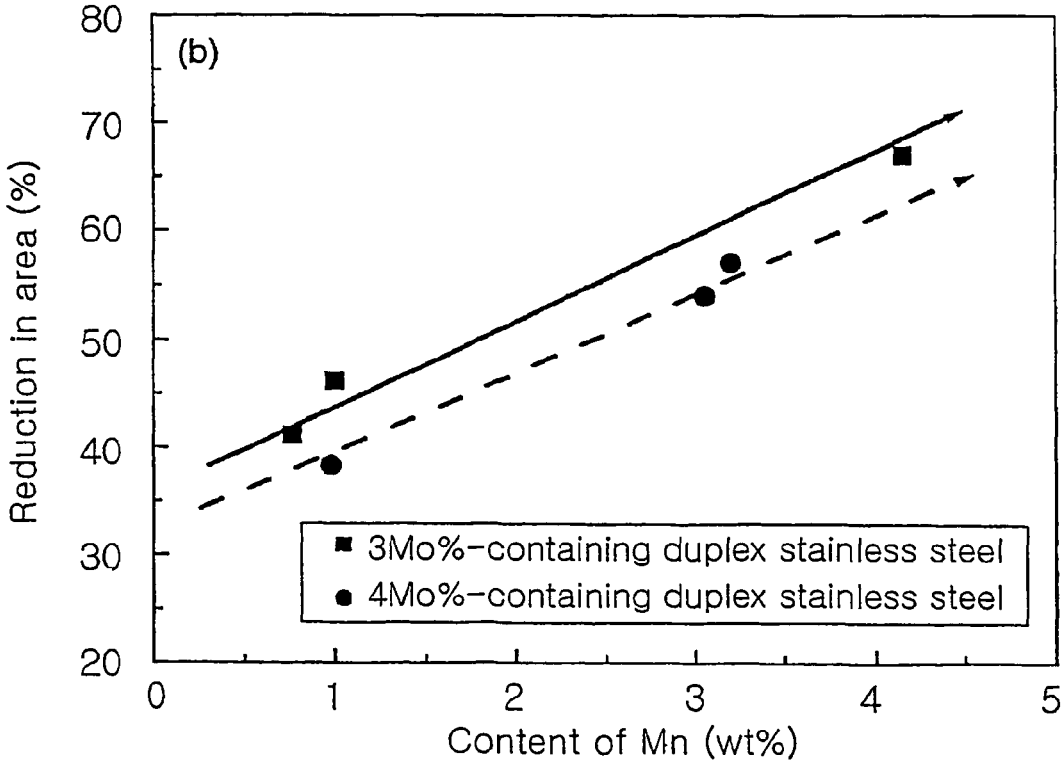

FIG. 2(*a*) is a graph showing hot workability (reduction in area) according to added amount of Mo, in a low Mn-containing duplex stainless steel and a high Mn-containing duplex stainless steel. As the added amount of Mo decreases, hot workability is improved.

That is, in a Mo-containing duplex stainless steel, as the content of Mn increases, hot workability is improved, in the case where the content of Mo is constant. While, in the case where the content of Mn is constant, as the content of Mo increases, hot workability becomes worse. Accordingly, hot workability can be more stably obtained by adjusting the two-component balance of Mn and Mo in a Mo-containing duplex stainless steel. In accordance with the present invention, in order to secure a reduction in area greater than 50% at 1,050° C., the duplex stainless steel should meet the following formula:

$$RA(\%)=44.37+9.806[\%\ Mn]-3.08[\%\ Mo]-0.76[\%\ Mn][\%\ Mo]\geqq 50$$

(3) Hot Workability in a W-Containing Duplex Stainless Steel

As shown in Table 3, in a high Mn-containing duplex stainless steel, as the content of W increases, hot workability (reduction in area) is improved, while, in a low Mn-containing duplex stainless steel, as the content of W increases, hot workability is lowered. That is, in a high Mn-containing duplex stainless steel, W and Mn have a synergistic effect on improvement of hot workability. The synergistic effect of W and Mn is also applied to a Mo—W containing duplex stainless steel in the same manner.

The present invention has been completed based on the results of (1), (2) and (3) above. Now, the components and compositions of the duplex stainless steel according to the present invention will be described in detail.

Carbon (C): Less than 0.1%

C is a strong carbide former, which binds with carbide forming elements such as Cr, Mo, W, Nb and V, contributing to high hardness of materials. However, if carbon is excessively added, it is precipitated in the form of excess carbide at the ferrite-austenite phase boundaries, with the result that corrosion resistance is lowered. In the present steel, if carbon is added in amounts more than 0.1%, it is easily precipitated in the form of coarse chromium carbide at the grain boundaries. As a result, the content of chromium is lowered around the grain boundaries, thereby corrosion resistance being lowered. Therefore, it is preferable to limit the content of carbon to less than 0.1%. Furthermore, in order to maximize strength and corrosion resistance, the content of carbon should be limited to less than 0.03%.

Silicon (Si): 0.05 to 2.2%

Si acts as a deoxidizing agent and improves the fluidity of the molten steel. For this purpose, Si must be added in an amount of at least 0.05%. However, when the content of Si exceeds 2.2%, mechanical properties in relation to impact toughness are drastically reduced.

Manganese (Mn): 2.1 to 7.8%

In conventional duplex stainless steels, Mn was considered to be harmful in hot workability. Therefore, Mn was added in an amount of 0.4-1.2%, so as only to adjust deoxidation, desulfurization or the fluidity of the molten metal. In contrast, in the steel of the present invention, Mn is positively employed since Mn acts synergistically with Mo and W to improve hot workability. Further, Mn can replace expensive Ni, which is desirable from an economic point of view. Generally, it is known that austenite phase stabilizing ability of Mn is 50% of that of Ni. For these effects, in the steel of the present invention, Mn is added in an amount of at least 2.1%. However, if the content of Mn exceeds 7.8%, during hot working of slab or billet, the surface of the slab or billet is severely oxidized. Further, oxidation scale thus generated lowers production yield, and removal of the oxidation scale is also difficult. Within the above defined range, Mn improves fluidity upon casting and thus is suitable for casting into thin or intricately shaped structures.

In the Mo-containing (no W) duplex stainless steel of the present invention, in the case where the content of Cr is as high as 26-29%, the lower limit of Mn is preferably set to 3.1%, so as to control excessive increase of the percentage of ferrite phase.

Nickel (Ni): 3.0 to 9.5%

Ni is an austenite stabilizing element. In the steel of the present invention, because Mn serves to somewhat stabilize the austenite phase, considering the balance between austenite stabilizers and ferrite stabilizers, the content of Ni is preferably limited to 3.0-9.5%. In the Mo-containing (no W) duplex stainless steel of the present invention, preferably, where the content of Cr is 20-26% (except 26%), the content of Ni is set to 4.1-8.8%, while where the content of Cr is 26-29%, the content of Ni is set to 4.1-9.5%.

Chromium (Cr): 20 to 29%

Cr is a ferrite stabilizing element. It is an essential element for improving corrosion resistance and establishing duplex phase structure consisting of ferrite phase and austenite phase. If the content of Cr is less than 20%, the duplex stainless steel cannot have the required corrosion resistance. On the other hand, if Cr exceeds 29%, the formation of sigma phase is promoted and brittleness increases. Also, low-temperature brittleness occurs around 475° C.

Nitrogen (N): 0.08 to 0.5%

N is a strong austenite stabilizing element and reduces the use of expensive Ni, similar to Mn. Also, N is effective for improving the pitting corrosion resistance and corrosion resistance. Generally, 0.02% of N is added to stainless steel materials as impurity. For the above purposes, however, N should be added in an amount of at least 0.08%. However, if the content of N exceeds 0.5%, corrosion resistance increases but casting defects such as blow holes and like are likely to be present during ingot casting or continuous casting, thereby degrading quality of steel. Meanwhile, in the Mo-containing (no W) duplex stainless steel of the present invention, if the content of N exceeds 0.345%, hot workability is deteriorated.

To the components defined above, Mo and W are added, alone or in combination.

Molybdenum (Mo): Less than 5.0%

Mo is a ferrite stabilizing element and corrosion resistance improving element. In particular, Mo improves critical corrosion resistance at certain acidities. However, if the content of Mo exceeds 5.0%, formation of sigma phase is likely to result during casting or hot working, thereby strength and toughness being drastically lowered. If higher corrosion resistance is required, the content of Mo is preferably set to more than 1.0%.

In the Mo-containing (no W) duplex stainless steel of the present invention, the two-component balance of Mn and Mo should be considered in order to more stably secure hot workability. In order to secure a reduction in area greater than 50% at 1,050° C., the duplex stainless steel should meet the following formula, which is obtained from the graph of FIG. 2:

$$RA(\%)=44.37+9.806[\%\ Mn]-3.08[\%\ Mo]-0.76[\%\ Mn][\%\ Mo]\geqq 50$$

Tungsten (W): 1.2 to 8%

W is a ferrite stabilizing element and corrosion resistance improving element. In particular, W improves critical corrosion resistance at certain acidities. Also, W enhances hot workability in a high Mn-containing duplex stainless steel. However, if the content of W is less than 1.2%, the above mentioned effects become insufficient, while if the content of W exceeds 8%, formation of sigma phase is likely to result during casting or hot working, thereby strength and toughness being drastically lowered. The reason why the upper limit of W is higher than that of Mo, is that the heavy atomic weight of W makes it difficult to diffuse, thereby delaying the formation of sigma phase in such higher W content. And, in the case where W is added in the same weight ratio as Mo, atomic ratio of W to Mo corresponds to about 1 to 2, thereby giving the same effect as cutting the amount of W added by half. Therefore, the balance percentage of ferrite phase and austenite phase is little of concern here. Considering the above aspect, when Mo and W are compositely added, their contents should meet the following relation: Mo+0.5W=0.8-4.4%, so as to secure more corrosion resistance.

P, S and O are added to the duplex stainless steel of the present invention as impurities. Their contents should be preferably minimized.

Phosphorus (P): Less than 0.03%

Because P is segregated in the grain boundaries or phase boundaries and thus corrosion susceptibility increases and toughness deteriorates, it must be added in as small amounts as possible. However, if the content of P is too low, refining cost becomes too high. Therefore, it is preferable to limit P to less than 0.03%.

Sulfur (S): Less than 0.03%

S deteriorates hot workability or forms MnS, thereby decreasing corrosion resistance. Thus, it is preferable to define the content of S as low as possible, i.e., less than 0.03%. In particular, in order to obtain higher corrosion resistance, it is preferable to limit S to less than 0.003%.

Oxygen (O): Less than 0.025%

O forms an oxide type non-metallic inclusion, deteriorating purity of the steel. Because O adversely influences bendability and press castability, it is preferable to define the content of O as low as possible. Therefore, the upper limit of O is 0.025%.

In the duplex stainless steel of the present invention, the corrosion resistance is greatly affected by the elements Cr, Mo, W and N. Corrosion resistance is described as PREN (Pitting Resistance Equivalent Number). If PREN is more than 35, the steel is considered to have a high corrosion resistance, while if it is less than 35, the steel is considered to have a low corrosion resistance.

$$PREN=\%\ Cr+3.3(\%\ Mo+0.5\%\ W)+30\%\ N$$

In order to improve the corrosion resistance and hot workability of the present steel with above composition better, the alloy elements such as Cu, Ca, B, Mg, Al, Ce, Nb, V, Zr, Ti and Ta can be further added.

Copper (Cu): Less than 1.0%

Cu is an austenite stabilizing element. Cu forms a protective layer, improving corrosion resistance, and is precipitated in the form of Cu complex particle, increasing strength. However, if the content of Cu exceeds 1.0%, hot workability is markedly deteriorated.

One Element or More than Two Elements Selected from the Group Consisting of Nb, V, Zr, Ti and Ta Nb, V and Zr form Nb(CN), $V_4(CN)_3$ and Zr(CN) carbides, respectively. They can be added to control formation of Cr type carbide ($M_{23}C_6$), thereby preventing formation of corrosion in the grain boundaries. In addition to the above effects, they increase strength by solution strengthening and particle reinforcement. However, if the content of each of Nb and V exceeds 0.4% or if the content of Zr exceeds 1.0%, the above carbides are formed coarsely, causing the reduction of toughness and ductility. Ti and Ta are added in order to control corrosion susceptibility in the grain boundaries or reinforce strength effectively. For this purpose, each of Ti and Ta should be added in an amount of less than 0.4%.

One Element or More than Two Elements Selected from the Group Consisting of Ca, B, Mg, Al and Ce.

When each of Ca, B and Mg is added to be 0.001-0.01%, or Ce is added to be less than 0.18%, excellent hot workability can be obtained. If the content of each of Ca, B and Mg is less than 0.001%, the addition effect is insignificant, while if it exceeds 0.01%, injection into the molten steel is very difficult and no additional effect is seen. In particular, Ca and B form coarse oxide inclusions or borides, thereby deteriorating hot workability. If the content of Ce exceeds 0.18%, coarse oxides are widespread, thereby deteriorating hot workability. If Al is added in an amount of 0.001-0.05%, deoxidation is promoted, thereby more purified casting products being obtained and hot workability being improved. However, if the content of Al exceeds 0.05%, in a high nitrogen-containing duplex stainless steel such as the steel of the present invention, AlN is formed, thereby deteriorating toughness. Also, the content of solid-soluble nitrogen is reduced and thus, corrosion resistance is reduced.

The steel with the above mentioned composition can be manufactured into casting products by casting, or into finished product forms such as plate, wire, bar and pipe by hot working such as forging, rolling and extrusion. Also, the present steel can be used as a material (wire) for hardfacing, which is suitable for enhancing physical properties of the surface of common carbon steel.

Upon manufacturing the steel into the casting products or finished product forms, in order to remove sigma phase, segregation or deformation texture, solution heat treatment can be done at a temperature of 1,050 to 1,250° C. If the temperature is less than 1,050° C., the sigma phase is easily formed and thus the corrosion resistance deteriorates. On the other hand, if the temperature exceeds 1,250° C., the percentage of austenite phase increases excessively, thereby strength decreasing and heat treatment cost increasing tremendously. Also, the solution heat treatment makes it possible to remove textures adversely affecting corrosion resistance of duplex stainless steel and thus increase corrosion resistance still more.

In particular, in the case where the steels are manufactured into the finished product forms (plate, wire, and bar), the solution heat treatment is followed by hot working. Preferably, hot working is initiated at a temperature of 1,130 to 1,280° C. and is terminated at a temperature of more than 1,000° C. As can be seen from FIG. 4, reduction in area is highest at a temperature of 1,130 to 1,280° C., and termination temperature of hot working is preferably more than 1,000° C. Cooling after the hot working is preferably carried out within the temperature range from 1,000 to 700° C. at a cooling rate of more than 3° C./min. If the cooling rate is less than 3° C./min within the above mentioned temperature range, precipitates, including mainly sigma phase, increase.

The following examples are given only as an illustration of the present invention and are not intended to be construed as a limitation thereof.

Example 1

Various steels, each having the composition as shown in Table 2 below, were melted and cast into ingots in a vacuum furnace. The ingots were then solution heated at a temperature of 1,200° C. in a heating furnace for 2 hours to obtain specimens. In carrying out room-temperature tensile test, the ingots or specimens were solution heated under the conditions mentioned previously and then water cooled. Corrosion resistance was measured as weight loss at room temperature in 10% $FeCl_3.6H_2O$ solution for 72 hours. Corrosion rates of each of the tested steels are summarized in Table 3, below.

TABLE 2

| | Chemical composition (wt %) | | | | | | | | | | | | |
|---|---|---|---|---|---|---|---|---|---|---|---|---|---|
| Steel | C | Si | Mn | Cr | W | Mo | Ni | N | Cu | V | Nb | Ti | Ta |
| Inventive 1 | 0.027 | 0.8 | 4.2 | 22.5 | 5.0 | — | 4.3 | 0.22 | — | | | | |
| Inventive 2 | 0.030 | 0.8 | 4.6 | 21.3 | 4.5 | 0.55 | 4.3 | 0.23 | 0.45 | | | | |
| Inventive 3 | 0.029 | 0.9 | 4.8 | 23.5 | 4.8 | 0.58 | 4.5 | 0.20 | 0.48 | | | | |
| Inventive 4 | 0.032 | 0.8 | 4.6 | 27.1 | 3.5 | 0.46 | 4.8 | 0.20 | 0.51 | | | | |
| Inventive 5 | 0.028 | 0.8 | 4.7 | 24.9 | 4.7 | 0.45 | 4.4 | 0.14 | 0.50 | | | | |
| Inventive 6 | 0.035 | 0.8 | 4.6 | 25.4 | 4.6 | 0.49 | 4.3 | 0.18 | 0.46 | | | | |
| Inventive 7 | 0.031 | 0.8 | 4.5 | 24.8 | 4.6 | 0.57 | 4.4 | 0.22 | 0.49 | | | | |
| Inventive 8 | 0.030 | 0.8 | 4.5 | 25.1 | 2.0 | 0.44 | 3.9 | 0.21 | 0.48 | | | | |
| Inventive 9 | 0.032 | 0.8 | 5.0 | 21.9 | 6.1 | 0.45 | 4.3 | 0.23 | 0.47 | | | | 0.1 |
| Inventive 10 | 0.033 | 0.8 | 4.6 | 26.5 | 4.5 | 0.46 | 4.7 | 0.21 | 0.48 | 0.1 | 0.1 | 0.05 | — |
| Comparative 1 | 0.028 | 0.6 | 0.8 | 17.2 | — | 2.50 | 12.2 | 0.02 | | | | | |
| Comparative 2 | 0.075 | 0.6 | 0.8 | 17.1 | — | 2.45 | 12.1 | 0.02 | | | | | |

TABLE 3

| Steel | Yield strength (Mpa) | Elongation (%) | Corrosion rate (mm/year) |
|---|---|---|---|
| Inventive 1 | 560 | 32.0 | 0.196 |
| Inventive 2 | 575 | 30.1 | 0.228 |
| Inventive 3 | 596 | 29.7 | 0.206 |
| Inventive 4 | 580 | 29.2 | 0.105 |
| Inventive 5 | 700 | 12.6 | 0.212 |
| Inventive 6 | 678 | 13.4 | 0.124 |
| Inventive 7 | 649 | 19.0 | 0.082 |
| Inventive 8 | 605 | 32.0 | 0.244 |
| Inventive 9 | 635 | 26.4 | 0.089 |
| Comparative 1 | 220 | 55.0 | 0.617 |
| Comparative 2 | 290 | 52.0 | 0.702 |

As can be seen from the Table 3, austenite stainless steels (comparative 1 and 2), which are most widely used in industrial fields, had yield strengths of about 220-290 MPa and room-temperature ductility of more than 50%. In contrast, the inventive steels had yield strengths of 575-700 MPa, which is more than 2 times that of comparative steels, and excellent room-temperature ductility of 12-32%.

As a result of measurement of weight loss by corrosion in 10% $FeCl_3.6H_2O$ solution, comparative steels were all severely corroded, at 0.617-0.702 mm/year. However, corrosion rates of the inventive steels were 0.082-0.244 mm/year. That is, the corrosion resistances of the inventive steels are 3 to 9 times better than comparative steels. From the above results, it can be seen that the inventive steels have both increased strength and enhanced corrosion resistance.

Example 2

Inventive steels from Table 2 were solution heated under the conditions of Table 4 below, and then their mechanical properties and corrosion rates were measured. The results are presented in Table 4 below.

TABLE 4

| Steel | Heat treatment condition | Yield strength (MPa) | Elongation (%) | Corrosion rate (mm/year) |
|---|---|---|---|---|
| Comparative | As cast state | 606 | 14.8 | 0.285 |
| Comparative | 950° C./2 hr | 641 | 13.2 | 0.325 |
| Inventive | 1,150° C./2 hr | 659 | 20.2 | 0.067 |
| Inventive | 1,250° C./2 hr | 649 | 19.0 | 0.082 |

As shown in Table 4, the inventive steels which had been solution heated, had higher room-temperature ductility as well as superior corrosion resistance, than comparative steels in an as-cast state.

Consequently, the inventive steels have equal or superior corrosion resistance relative to conventional steels, such as 304 or 316 type austenite stainless steels, and are excellent in strength. Therefore, the inventive steels can extend lifetimes of chemical equipments, electric power stations, and marine related equipments, and contribute to enhancement of working efficiency.

Example 3

Various duplex stainless steels, each having the composition as shown in Table 5 below, were melted and cast into ingots in a vacuum furnace. The ingots were then solution heated at a temperature of 1,200° C. in a heating furnace for 2 hours to obtain specimens. In carrying out room-temperature tensile test, the ingots or specimens were solution heated under the conditions mentioned previously and then water cooled. Corrosion resistance was measured as weight loss at room temperature in 10% $FeCl_3.6H_2O$ solution for 72 hours. Corrosion rates of each of the tested steels are summarized in Table 6, below. The inventive steels from Table 5 all are high corrosion resistant duplex stainless steels, which have PREN values of more than 35.

TABLE 6

| Steel | Yield strength (MPa) | Elongation (%) | Corrosion rate (mm/year) |
|---|---|---|---|
| Inventive 1 | 550 | 23.0 | 0.022 |
| Inventive 2 | 521 | 21.1 | 0.037 |
| Inventive 3 | 630 | 20.0 | 0.057 |
| Inventive 4 | 689 | 17.5 | 0.052 |
| Inventive 5 | 655 | 18.0 | 0.026 |
| Inventive 6 | 620 | 30.0 | 0.005 |
| Inventive 7 | 690 | 19.3 | 0.038 |
| Inventive 8 | 730 | 18.7 | 0.028 |
| Inventive 9 | 620 | 32.0 | 0.043 |
| Inventive 10 | 555 | 34.5 | 0.013 |
| Inventive 11 | 663 | 24.4 | 0.021 |
| Inventive 12 | 657 | 25.4 | 0.031 |
| Comparative 1 | 220 | 55.0 | 0.617 |
| Comparative 2 | 290 | 52.0 | 0.702 |
| Inventive 13 | 680 | 8.6 | 0.195 |
| Inventive 14 | 649 | 18.9 | 0.121 |
| Inventive 15 | 600 | 27.2 | 0.198 |
| Inventive 16 | 565 | 29.5 | 0.205 |

As can be seen from Table 6, austenite stainless steels (comparative 1 and 2), which are most widely used in industrial fields, had yield strengths of about 220-290 MPa, and room-temperature ductility of more than 50%. In contrast, the inventive steels had yield strengths of 520-730 MPa, which is 2 times higher than that of comparative steels, and excellent room-temperature ductility of 17.5-34.5%.

As a result of measurement of weight loss by corrosion in 10% $FeCl_3.6H_2O$ solution, comparative steels 1 and 2 were severely corroded, at. 0.617-0.702 mm/year. However, corrosion rate of the inventive steels was 0.005-0.057 mm/year. That is, the corrosion resistances of the inventive steels are 10 to 100 times that of comparative steels. From the above results, it can be seen that the inventive steels have both increased strength and enhanced corrosion resistance.

Inventive steels 13 and 14, which are lower than the inventive steels in nitrogen content, had poor corrosion rates of 0.121-0.195 mm/year. That is, the corrosion resistances of the inventive steels 13 and 14 are ⅓ to 1/24 that of the inventive steels 1-12. Inventive steels 15 and 16 in which the content of W or Cr is low, had corrosion resistances only ¼ to 1/40 that of the inventive steels 1-12. Although inventive steels 13 to 16 are equal to the inventive steels 1-12 with respect to yield

TABLE 5

| | Chemical composition (wt %) | | | | | | | | | | | | |
|---|---|---|---|---|---|---|---|---|---|---|---|---|---|
| Steel | C | Si | Mn | Cr | W | Mo | Ni | N | Cu | V | Nb | Ti | Ta |
| Invetion 1 | 0.030 | 0.81 | 3.78 | 25.22 | 5.10 | — | 5.01 | 0.30 | 0.5 | | | | |
| Invetion 2 | 0.018 | 0.80 | 4.08 | 24.97 | 4.35 | 0.45 | 4.69 | 0.27 | 0.5 | | | | |
| Invetion 3 | 0.032 | 0.82 | 4.64 | 24.96 | 4.50 | 0.48 | 4.57 | 0.27 | 0.5 | | | | |
| Invetion 4 | 0.049 | 0.81 | 4.80 | 24.80 | 4.52 | 0.56 | 4.40 | 0.27 | 0.5 | | | | |
| Invetion 5 | 0.092 | 0.80 | 4.61 | 24.96 | 4.64 | 0.48 | 4.37 | 0.29 | 0.5 | | | | |
| Invetion 6 | 0.032 | 0.86 | 4.80 | 23.45 | 4.81 | 0.58 | 4.52 | 0.30 | 0.5 | | | | |
| Invetion 7 | 0.032 | 0.78 | 4.60 | 27.08 | 4.61 | 0.46 | 4.50 | 0.32 | 0.5 | | | | |
| Invetion 8 | 0.033 | 0.77 | 4.50 | 29.10 | 4.56 | 0.44 | 4.40 | 0.32 | 0.5 | | | | |
| Invetion 9 | 0.035 | 0.81 | 4.50 | 24.90 | 4.51 | 0.44 | 4.42 | 0.36 | 0.5 | | | | |
| Invetion 10 | 0.036 | 0.81 | 4.49 | 24.95 | 4.62 | 0.45 | 4.43 | 0.45 | 0.5 | | | | |
| Invetion 11 | 0.032 | 0.80 | 4.48 | 24.97 | 6.09 | 0.45 | 4.33 | 0.30 | 0.5 | | | | 0.1 |
| Invetion 12 | 0.031 | 0.78 | 4.58 | 25.02 | 4.39 | 0.46 | 4.38 | 0.32 | 0.5 | 0.1 | 0.1 | 0.05 | |
| Comparative 1 | 0.028 | 0.60 | 0.80 | 17.20 | — | 2.50 | 12.2 | 0.02 | | | | | |
| Comparative 2 | 0.075 | 0.60 | 0.80 | 17.10 | — | 2.45 | 12.1 | 0.02 | | | | | |
| Inventive 13 | 0.030 | 0.79 | 4.63 | 25.43 | 4.60 | 0.49 | 4.35 | 0.18 | | | | | |
| Inventive 14 | 0.031 | 0.81 | 4.45 | 24.55 | 4.52 | 0.37 | 4.40 | 0.22 | | | | | |
| Inventive 15 | 0.030 | 0.80 | 4.50 | 25.14 | 2.03 | 0.44 | 4.46 | 0.26 | | | | | |
| Inventive 16 | 0.030 | 0.80 | 4.62 | 21.30 | 4.59 | 0.55 | 4.30 | 0.24 | | | | | |

strength and elongation, due to their low corrosion resistance, they cannot be applied to structural parts requiring high corrosion resistance.

Consequently, the inventive steels have superior corrosion resistance relative to conventional steels, such as 304 or 316 type austenite stainless steels, or SAF 2205, and are excellent in yield strength. Therefore, the inventive steels can extend lifetimes of chemical equipments, electric power stations, and marine related equipments, and contribute to enhancement of working efficiency.

Example 4

Various duplex stainless steels and three kinds of commercial austenite stainless steels, each having the composition as shown in Table 7 below, were melted and cast into ingots in a vacuum furnace. The ingots were then solution heated at a temperature of 1,100-1,200° C. in a heating furnace for 2 hours to obtain specimens.

In carrying out room-temperature tensile test, the ingots or specimens were solution heated under the conditions mentioned previously and then water cooled. Corrosion resistance was measured as specimen's weight loss at room temperature in 10% $FeCl_3.6H_2O$ solution for 72 hours. Corrosion rates of each of the tested steels are summarized in Table 7, below. Meanwhile, the specimens were manufactured into 10 mm in diameter×120 mm in length tensile specimens in the form of bar, and then were hot tensile tested by local heating at 1050° C. Then, hot workability was investigated by measuring a reduction in area. The reason why the hot workability is investigated using specimens obtained from solution heat treatment of ingots, is that hot working processes are conventionally performed immediately after casting into ingots and then solution heating of the ingots. The yield strength and hot workability of the inventive steels are remarkably enhanced after hot working, compared with solution heated steels. This is because if steel is subjected to hot working process, its internal texture becomes even finer. Separately, room-temperature tensile test was conducted using a plate type tensile specimen of more than 25 mm in gauge length×cross section of 3 mm in thickness×5 mm in width.

TABLE 7

| | Chemical composition (wt. %) | | | | | | | | | | Hot work, | Corrosion rate | Yield Strength | |
|---|---|---|---|---|---|---|---|---|---|---|---|---|---|---|
| Steel | C | Si | Mn | Cr | W | Mo | Ni | Cu | N | Others | (%) | (mm/year) | (MPa) | |
| Speci.1 | 0.022 | 0.4 | 0.77 | 23.1 | — | 3.27 | 5.53 | — | 0.15 | — | 41 | 0.352 | 545 | X |
| Speci.2 | 0.022 | 0.4 | 0.79 | 23.0 | — | 3.15 | 8.40 | — | 0.15 | — | 27 | — | 410 | X |
| Speci.3 | 0.031 | 0.8 | 0.98 | 25.2 | — | 4.10 | 6.86 | — | 0.26 | — | 38 | 0.016 | 605 | X |
| Speci.4 | 0.035 | 0.8 | 1.00 | 25.7 | — | 3.20 | 5.60 | 1.80 | 0.20 | — | 46 | 0.032 | 680 | X |
| Speci.5 | 0.035 | 0.8 | 0.99 | 21.9 | — | 5.01 | 7.18 | — | 0.24 | — | 35 | 0.022 | 545 | X |
| Speci.6 | 0.027 | 0.6 | 4.15 | 23.0 | — | 3.12 | 5.45 | — | 0.15 | — | 66 | 0.315 | 550 | ○ |
| Speci.7 | 0.025 | 0.6 | 4.52 | 22.9 | — | 3.10 | 8.47 | — | 0.15 | — | 58 | — | 415 | ○ |
| Speci.8 | 0.023 | 0.5 | 2.41 | 23.0 | — | 3.02 | 8.72 | — | 0.16 | 0.0035Ca 0.0042B | 57 | — | 408 | ○ |
| Speci.9 | 0.022 | 0.5 | 2.53 | 22.9 | — | 3.05 | 8.60 | — | 0.16 | 0.0035Mg 0.0034B | 57 | — | 495 | ○ |
| Speci.10 | 0.025 | 0.5 | 2.63 | 23.0 | — | 3.12 | 8.68 | — | 0.16 | 0.0022Mg | 67 | — | 488 | ○ |
| Speci.11 | 0.022 | 0.4 | 3.52 | 23.0 | — | 3.10 | 8.63 | — | 0.16 | 0.0043B | 55 | — | 445 | ○ |
| Speci.12 | 0.026 | 0.6 | 3.05 | 25.2 | — | 4.15 | 7.05 | — | 0.30 | — | 54 | — | 540 | ○ |
| Speci.13 | 0.062 | 0.8 | 0.94 | 24.4 | 5.21 | — | 6.19 | 0.46 | 0.29 | — | 35 | 0.023 | 560 | X |
| Speci.14 | 0.028 | 0.8 | 4.52 | 24.2 | 6.02 | — | 4.75 | — | 0.26 | — | 66 | 0.022 | 612 | ○ |
| Speci.15 | 0.022 | 0.4 | 0.80 | 22.7 | 2.51 | 1.49 | 5.54 | — | 0.16 | — | 49 | — | 490 | X |
| Speci.16 | 0.023 | 0.4 | 0.81 | 22.7 | 2.55 | 1.48 | 8.88 | — | 0.15 | — | 37 | — | 410 | X |
| Speci.17 | 0.032 | 0.8 | 0.94 | 24.4 | 3.51 | 0.76 | 7.19 | 0.46 | 0.29 | — | 35 | 0.023 | 545 | X |
| Speci.18 | 0.032 | 0.8 | 0.98 | 24.6 | 3.30 | 2.67 | 6.90 | 1.33 | 0.29 | — | 21 | 0.015 | 640 | X |
| Speci.19 | 0.032 | 0.8 | 0.96 | 24.9 | 2.09 | 3.09 | 7.10 | 0.45 | 0.27 | — | 45 | 0.021 | 642 | X |
| Speci.20 | 0.018 | 0.8 | 4.08 | 25.0 | 4.35 | 0.45 | 4.69 | 0.48 | 0.27 | — | 65 | 0.118 | 521 | ○ |
| Speci.21 | 0.032 | 0.8 | 4.64 | 25.0 | 4.30 | 0.48 | 4.57 | 0.49 | 0.27 | — | 61 | 0.177 | 630 | ○ |
| Speci.22 | 0.049 | 0.8 | 4.80 | 24.8 | 4.52 | 0.56 | 4.40 | 0.48 | 0.27 | — | 55 | 0.082 | 689 | ○ |
| Speci.23 | 0.092 | 0.8 | 4.61 | 25.0 | 4.64 | 0.48 | 4.37 | 0.49 | 0.29 | — | 58 | 0.036 | 655 | ○ |
| Speci.24 | 0.030 | 0.8 | 4.62 | 21.3 | 3.59 | 0.55 | 4.30 | 0.49 | 0.24 | — | 55 | 0.077 | 575 | ○ |
| Speci.25 | 0.032 | 0.9 | 4.80 | 23.5 | 4.81 | 0.58 | 4.52 | 0.49 | 0.30 | — | 54 | 0.007 | 596 | ○ |
| Speci.26 | 0.032 | 0.8 | 4.60 | 27.1 | 4.61 | 0.46 | 4.50 | 0.48 | 0.32 | — | 63 | 0.009 | 580 | ○ |
| Speci.27 | 0.030 | 0.8 | 4.45 | 24.9 | 4.62 | 0.49 | 4.40 | 0.50 | 0.18 | — | 78 | 0.346 | 678 | ○ |
| Speci.28 | 0.031 | 0.8 | 4.63 | 25.4 | 4.60 | 0.57 | 4.35 | 0.49 | 0.22 | — | 67 | 0.082 | 649 | ○ |
| Speci.29 | 0.022 | 0.6 | 3.10 | 23.5 | 4.52 | 0.72 | 4.51 | 0.48 | 0.21 | — | 63 | 0.092 | 632 | ○ |
| Speci.30 | 0.025 | 0.7 | 2.31 | 23.5 | 5.01 | 0.65 | 4.52 | 0.47 | 0.23 | — | 58 | 0.095 | 650 | ○ |
| Speci.31 | 0.035 | 0.8 | 4.50 | 24.9 | 4.51 | 0.44 | 4.42 | 0.47 | 0.36 | — | 52 | 0.043 | 620 | ○ |
| Speci.32 | 0.036 | 0.8 | 4.49 | 25.0 | 4.62 | 0.45 | 4.43 | 0.47 | 0.45 | — | 50 | 0.017 | 555 | ○ |
| Speci.33 | 0.030 | 0.8 | 4.50 | 25.1 | 2.03 | 0.44 | 4.46 | 0.47 | 0.26 | — | 57 | 0.363 | 605 | ○ |
| Speci.34 | 0.032 | 0.8 | 4.48 | 25.0 | 6.09 | 0.45 | 4.33 | 0.45 | 0.30 | — | 68 | 0.006 | 635 | ○ |
| Speci.35 | 0.030 | 0.6 | 4.46 | 23.2 | 4.30 | 0.47 | 4.29 | 0.49 | 0.34 | 0.0021Mg 0.0034B | 55 | — | 560 | ○ |
| Speci.36 | 0.030 | 0.8 | 2.51 | 25.0 | 3.60 | 0.83 | 7.03 | 0.52 | 0.23 | 0.67Zr | 62 | 0.020 | 610 | ○ |
| Speci.37 | 0.043 | 0.5 | 2.37 | 24.0 | 3.70 | 0.80 | 6.63 | 0.47 | 0.31 | 0.12V | 61 | 0.018 | 530 | ○ |
| Speci.38 | 0.031 | 0.8 | 2.49 | 25.2 | 3.52 | 0.80 | 6.95 | 0.51 | 0.30 | 0.13Nb | 60 | 0.022 | 600 | ○ |
| Speci.39 | 0.029 | 0.8 | 2.54 | 25.1 | 3.41 | 0.79 | 7.01 | 0.51 | 0.17 | 0.29Ti | 76 | 0.019 | 630 | ○ |
| Speci.40 | 0.028 | 0.7 | 4.51 | 24.6 | 4.52 | 0.45 | 4.52 | — | 0.23 | 0.05Ta | 69 | — | 657 | ○ |
| Speci.41 | 0.027 | 0.8 | 4.35 | 24.3 | 4.61 | 0.49 | 4.57 | — | 0.23 | 0.01Ce, 0.005A1 | 70 | — | 645 | ○ |
| 316L | 0.028 | 0.6 | 0.80 | 17.2 | — | 2.50 | 12.2 | — | 0.043 | — | — | 0.617 | 220 | X |
| 316 | 0.075 | 0.6 | 0.80 | 17.1 | — | 2.45 | 12.1 | — | 0.020 | — | — | 0.702 | 290 | X |
| 304 | 0.030 | 0.8 | 1.00 | 19.3 | — | 10.7 | — | 0.033 | | 68 | 7.065 | 289 | X | |

TABLE 7-continued

| Steel | Chemical composition (wt. %) C | Si | Mn | Cr | W | Mo | Ni | Cu | N | Others | Hot work, (%) | Corrosion rate (mm/year) | Yield Strength (MPa) | |
|---|---|---|---|---|---|---|---|---|---|---|---|---|---|---|
| Conven.1 | 0.030 | 0.8 | 5.25 | 25.2 | — | 2.51 | 6.15 | 2.81 | 0.28 | | 28 | 0.105 | 455 | X |
| Conven.2 | 0.028 | 0.8 | 0.99 | 25.0 | — | 4.08 | 6.99 | — | 0.31 | | 34 | 0.016 | 610 | X |

○: inventive steel,
X: comparative steel
In all the specimens, the content of each of S and P is limited to less than 0.03%, and the content of oxygen is limited to less than 0.025%

In Table 7, 316L, 316 and 304 steels are austenite type stainless steels, which are most widely used in industrial fields, and have yield strengths of about 220-290 MPa. In contrast, the inventive steels are 120-400 Mpa higher than these austenite type stainless steels, with respect to yield strength. The corrosion rates of 316L, 316 and 304 steels range from 0.617 to 7.065 mm/year. In contrast, the corrosion rates of the inventive steels range from 0.007 to 0.363 mm/year, showing excellent corrosion resistance.

Specimens 1-5 are conventional commercial Mo-containing (no W) duplex stainless steels, and exhibit almost the same yield strength and corrosion resistance as the inventive steels. In spite of these advantages, they have severe problems in that hot workability is very low and thus defective proportion is very high, in particular in Ginger mill. The hot workability (reduction in area) of specimens 1-5 ranges from 27 to 46%, very poor values. However, inventive steels with the content of: Mn according to the present invention had hot workability (reduction in area) of 52-66%, resulting in enhancement of hot workability by more than 50%, compared with specimens 1-5.

Similar results to above were also obtained in W-containing (no Mo) duplex stainless steels. Specimen 13 is a W-containing (no Mo) duplex stainless steel. Due to low Mn content, it exhibited very low hot workability, i.e. about 35%. Specimen 14, of which Mn content is 4.52 wt %, had reduction in area of 66%, which is an enhancement of reduction in area by 88%, compared with specimen 13.

Similar results to the above were also obtained from Mo—W containing duplex stainless steels. Specimens 15-19 are conventional commercial steels, and their hot workability is very poor, i.e. 21-49%. However, the inventive counterparts, which have Mn contents according to the present invention, were enhanced by 50-78% with respect to reduction in area. Specifically, specimen 15, which is relatively low in alloy addition amount and N content, had 49% reduction in area but was the highest in reduction in area among comparative, low Mn-containing, Mo—W containing duplex stainless steels. Meanwhile, among the inventive counterparts, specimen 27, which has higher Mn content, had 78% reduction in area, about 59% higher than specimen 15. Specimen 18, which is relatively high in alloy addition amount and nitrogen content, had 21% reduction in area, the worst value. However, specimen 34, which has a similar composition to specimen 18, had 68% reduction in area, resulting in enhancement of hot workability of more than about 3 times, compared with specimen 18.

FIG. 1 is a graph showing influence of Mn content on hot workability in a variety of duplex stainless steels. The inventive steels exhibit remarkably improved hot workability relative to conventional commercial low Mn-containing stainless steels. In FIG. 1, A-type (specimens 1, 4, 6, 27, etc.) is one alloy group which is relatively low in alloy addition amount and nitrogen content, and B-type (specimens 5, 17, 12, 34, etc) is another alloy group which is relatively high in alloy addition amount and nitrogen content. It can be seen from the FIG. 1 that regardless of the alloy addition amount and nitrogen content, as the content of Mn increases, hot workability is gradually improved. This result is utterly opposed to the common perception that as the content of Mn increases, hot workability decreases.

FIG. 2(*a*) is a graph showing influence of Mo on hot workability, in low Mn-containing duplex stainless steels and high Mn-containing duplex stainless steels (specimens 1 to 12). It directly demonstrates the fact that as the content of Mn increases, hot workability is improved. As shown in FIG. 2(*a*), regardless of the content of Mn, as the content of Mo increases, hot workability decreases. FIG. 2(*b*) shows in Mo-containing duplex stainless steels that as the content of Mn increases, hot workability is improved, in the case where the content of Mo is constant.

Figure 3:
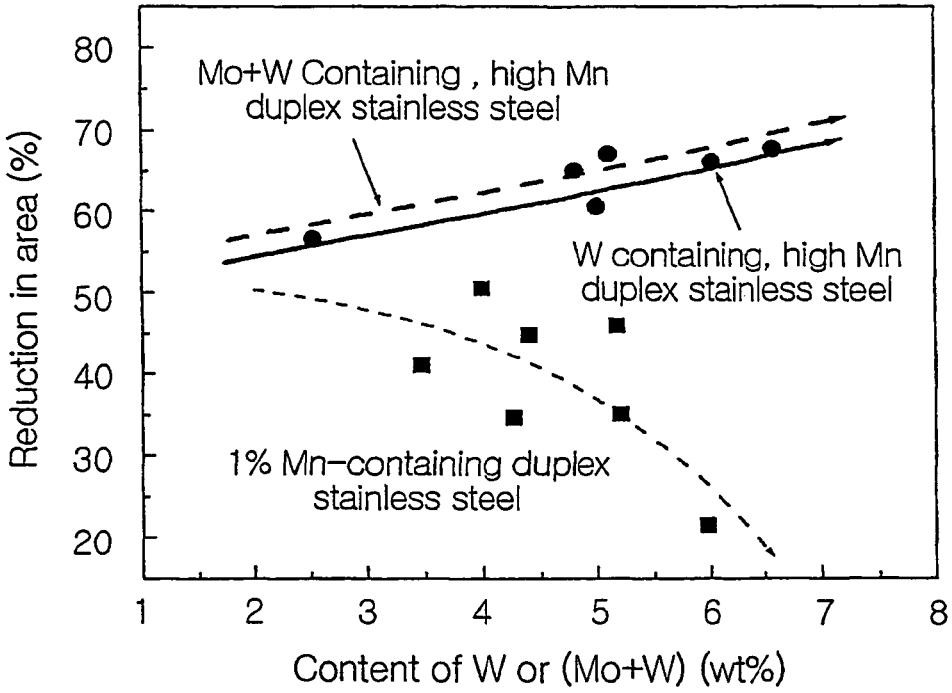
FIG. 3 is a graph showing hot workability (reduction in area) according to the content of W, in a low Mn-containing duplex stainless steel and a high Mn-containing duplex stainless steel.

FIG. 3 shows hot workability according to the content of W or W—Mo, in W— or W—Mo containing duplex stainless steels (specimens 13 to 41). FIG. 3 supports the conclusions of FIG. 1 that as the content of Mn increases, hot workability is improved. As for conventional 1% Mn-containing steels, as the content of W or W—Mo increases, hot workability is continuously reduced, while as for inventive high Mn-containing steels, as the content of W or W—Mo increases, hot workability is continuously increased. Accordingly, in inventive steels, in the case where Mn and W are compositely added, hot workability is more improved even in high alloy addition amount.

Meanwhile, in Mo—, W—, or W—Mo-containing steels, in the case where the content of Cu exceeds 1%, hot workability is very poor, as can be seen from specimens 4 and 18, and conventional steel 1 (U.S. Pat. No. 4,657,606). Consequently, addition of excessive Cu remarkably reduces hot workability.

Example 5

The inventive steel (for example, specimen 28) was cast and solution heated at a temperature of 1,050 to 1,250° C. Its physical properties are presented in Table 8 below.

As can be seen from the Table 8, strength was excellent, and corrosion resistance, ductility and impact toughness were improved.

TABLE 8

| Treatment condition | Yield strength (MPa) | Elongation (%) | Impact energy (3) | Corrosion rate (mm/year) |
|---|---|---|---|---|
| As-cast state | 606 | 14.8 | 11.6 | 0.225 |
| 1,100° C./2 hr | 662 | 19.8 | 185.0 | — |
| 1,150° C./2 hr | 659 | 20.2 | — | 0.067 |
| 1,200° C./2 hr | 649 | 19.0 | 96.0 | 0.082 |

Example 6

The inventive steel (specimen 28) and comparative steel (specimen 17) were measured for hot workability. The results are shown in FIG. 4.

Figure 4:
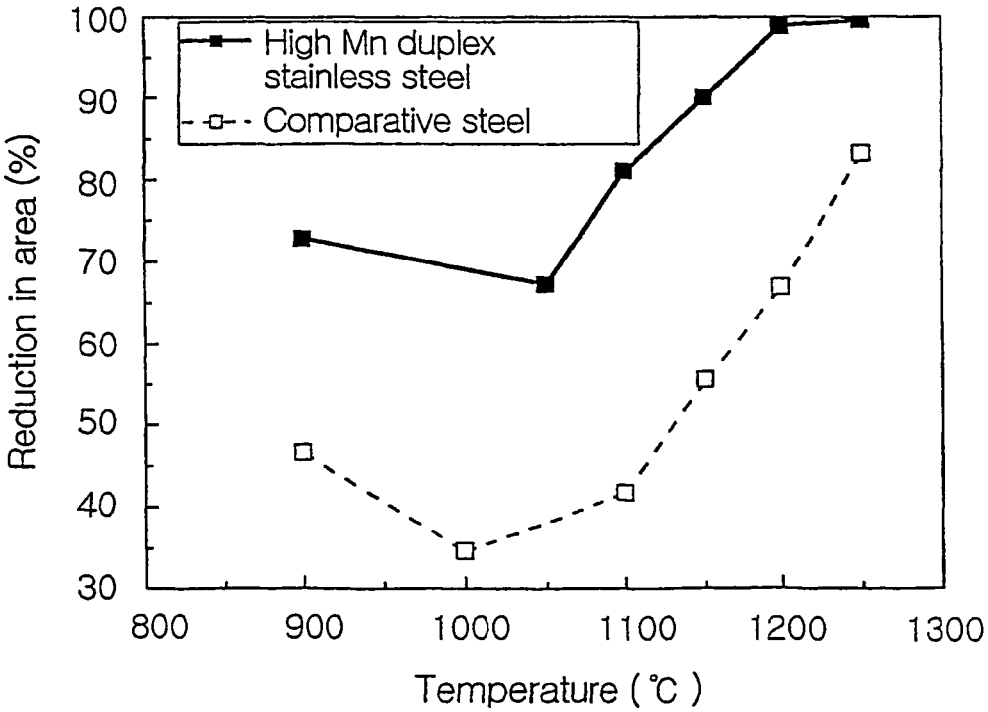
FIG. 4 is a graph showing hot workability (reduction in area) according to temperature, in the inventive steel and comparative steel.

As shown in FIG. 4, it can be seen that the inventive steel is superior in hot workability to comparative steel. The inventive steel (specimen 28) exhibited reduction in area of 90-99.52%, while the comparative steel (specimen 17) exhibited reduction in area of 55-83%. Consequently, higher temperatures than in the inventive steel must inevitably be applied to the comparative steel. That is, in order to adequately hot work the comparative steel, working temperature must be increased. As a result, there are problems in that excessive energy is consumed, as well as hot workability is low, resulting in increase of defective proportion. The hot working of the inventive steels can be initiated at lower temperatures.

Although the hot workability of the inventive steels is superior to the comparative steels, it reduces below 1000° C. Therefore, hot working of the inventive steels must be terminated at more than 1000° C.

Meanwhile, specimen 28 was measured for the amounts of precipitates (mainly sigma phase) formed within the temperature range from 1000 to 700° C. at various cooling rates. Then, the specimen 28 was air cooled from 700° C. to room temperature. The quantitative results are shown in Table 9. As shown in Table 9, 6.5% of precipitates are formed at the cooling rate of 1° C./min, 0.8% of precipitates are formed at the cooling rate of 5° C./min, and few precipitates are formed at 50° C./min. In the case where precipitates (mainly sigma phase) are formed, toughness of the steel was drastically deteriorated. As a result, internal cracks were easily formed during cooling and corrosion resistance and cold workability in stainless steel products were deteriorated. Generally, it is preferred that the amount of the precipitates is limited to less than 2%.

TABLE 9

| Cooling rate | 1° C./min | 5° C./min | 50° C./min | 100° C./min |
|---|---|---|---|---|
| Amount of precipitates (%) | 6.5 | 0.8 | 0 | 0 |

Example 7

Figure 5A:
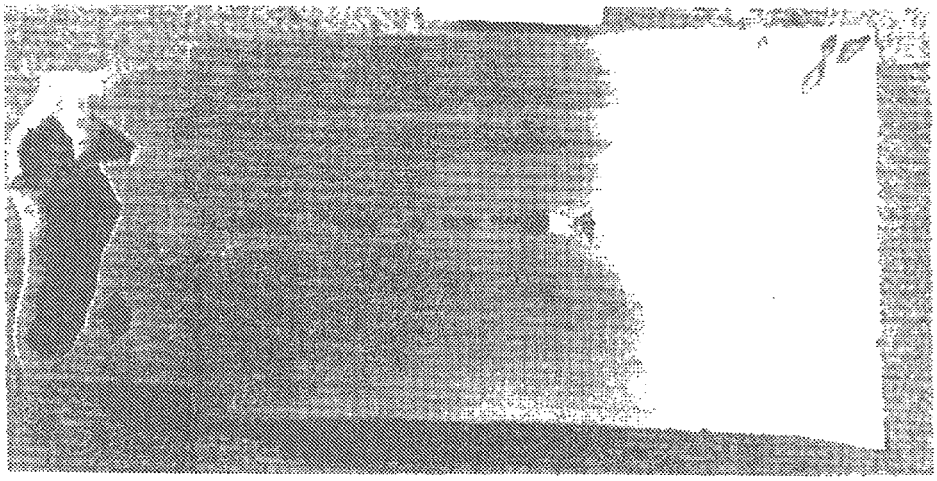
FIG. 5a (Prior Art)
FIG. 5(*a*) is a photograph showing the interior of the cast slabs of the inventive steel.
Figure 5B:
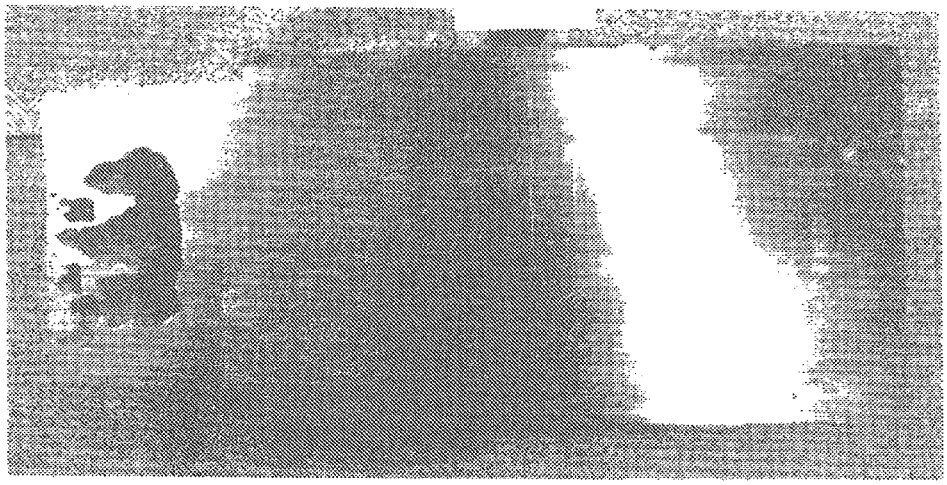

The inventive steel (specimen 29) and conventional steel 2 from the Table 7 were cast and internal photographs of the cast slabs are shown in FIG. 5.

The inventive steel (specimen 29) was excellent in castability due to high Mn content. The inventive steels have an advantage of reducing occurrence of cracks in the interior of soft billet or ingot, compared with conventional duplex stainless steels. As shown in FIG. 5(*a*), as for conventional steel 2, although hot top sleeves were put on top of ingot mold in order to avoid formation of shrinkage cavities in ingots, shrinkage cavities formed to finally comprise 65% of the whole cast slabs. In contrast, as for the inventive steel (specimen 29, see FIG. 5(*b*)), shrinkage cavities formed only 15% of the whole cast slabs. Accordingly, the inventive high Mn-containing steels contribute to the reduction of casting defects.

INDUSTRIAL APPLICABILITY

As apparent from the above description, the present invention provides a duplex stainless steel, which is excellent in corrosion resistance, strength and hot workability, relative to 304 or 316 type austenite stainless steels. The duplex stainless steels of the present invention are excellent in castability and thus can be easily cast into thin products or intricately shaped products. In particular, due to high hot workability, the duplex stainless steels of the present invention can be made into finished product forms, including plate, wire, bar, pipe, and the like.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A high manganese duplex stainless steel with excellent hot workability, comprising (in weight %): 0.018%-0.1% of C; 0.05-2.2% of Si; 3.52-7.8% of Mn; 20-27.8% of Cr; 3.0-9.5% of Ni; 0.08-0.5% N; up to 4.15% Mo; 3.41-8% W; less than 1.0% Cu; less than 0.4% Ti; the balance Fe and inevitable impurities and wherein Mo and W meet the condition: Mo+0.5W=1.0-4.4% and having a reduction in area of 50% or more when measured at 1,050° C. and a corrosion rate of less than 0.36 mm/year as determined by weight loss after exposure in a 10% $FeCl_2.6H_2O$ solution for 72 hours at room temperature.

2. The high manganese duplex stainless steel as set forth in claim 1, wherein the content of Mo is 1.0-4.15%.

3. The high manganese duplex stainless steel as set forth in claim 1, wherein the contents of Mo and Mn meet the following formula: 44.37+9.806 [% Mn]−3.08 [% Mo]−0.76 [% Mn] [% Mo]≧50.

4. The high manganese duplex stainless steel as set forth in claim 1, wherein the contents of Cr, Mo, W and N meet the following formula: PREN=% Cr+3.3(% Mo+0.5% W)+30% N≧35.

5. The high manganese duplex stainless steel as set forth in claim 1, wherein the content of C is 0.018-0.03%.

6. The high manganese duplex stainless steel as set forth in claim 1, which further comprises one element or more than two elements selected from the group consisting of less than 0.4% of Nb; less than 0.4% of V; less than 1.0% of Zr; and less than 0.4% of Ta.

7. The high manganese duplex stainless steel as set forth in claim 1, which further comprises one or two elements selected from the group consisting of less than 0.18% of Ce; 0.001-0.01% of Ca; 0.001-0.01% of B; 0.001-0.01% of Mg; and 0.001-0.05% of Al.

8. A method for manufacturing a high manganese duplex stainless steel comprising solution heating a duplex stainless steel comprising (in weight %): 0.018%-0.1% of C; 0.05-2.2% of Si; 3.52-7.8% of Mn; 20-27.8% of Cr; 3.0-9.5% of Ni; 0.08-0.5% N; up to 4.15% Mo; 3.41-8% W; less than 1.0% Cu; less than 0.4% Ti; the balance Fe and inevitable impurities and wherein Mo and W meet the condition: Mo+0.5W=1.0-4.4% at a temperature of 1,050 to 1,250° C., wherein the steel has a reduction in area of 50% or more when measured at 1,050° C. and a corrosion rate of less than 0.36 mm/year as determined by weight loss after exposure in a 10% $FeCl_2.6H_2O$ solution for 72 hours at room temperature.

9. The method as set forth in claim 8, which comprises the steps of: solution heating the duplex stainless steel as set forth in claim 1 at a temperature of 1,050 to 1,250° C., hot working, which is initiated at a temperature of 1,130 to 1,280° C. and then terminated at a temperature of more than 1,000° C., and then cooling within the temperature range from 1,000 to 700° C. at a cooling rate of more than 3° C./min.

10. The method as set forth in claim 8, wherein the content of Mo is 1.0-4.15%.

11. The method as set forth in claim 8, wherein the contents of Mo and Mn meet the following formula: 44.37+9.806 [% Mn]−3.08 [% Mo]−0.76% [% Mn][% Mo]≧50.

12. The method as set forth in claim 8, wherein the contents of Cr, Mo, W and N meet the following formula: PREN=% Cr+3.3 (% Mo=0.5% W)+30% N≧35.

13. The method as set forth in claim 8, wherein the content of C is 0.018-0.03%.

14. The method as set forth in claim 8, wherein the steel further comprises one element or more than two elements selected from the group consisting of less than 0.4% of Nb; less than 0.4% of V; less than 1.0% of Zr; and less than 0.4% of Ta.

15. The method as set forth in claim 8, wherein the steel further comprises one or two elements selected from the group consisting of less than 0.18% of Ce; 0.001-0.01% of Ca; 0.001-0.01% of B; 0.001-0.01% of Mg; and 0.001-0.05% of Al.

* * * * *

UNITED STATES PATENT AND TRADEMARK OFFICE

CERTIFICATE OF CORRECTION

PATENT NO. : 8,043,446 B2
APPLICATION NO. : 10/398128
DATED : October 25, 2011
INVENTOR(S) : Jae-Young Jung et al.

It is certified that error appears in the above-identified patent and that said Letters Patent is hereby corrected as shown below:

Title Page of Patent, Column 1, Item (54), Line 3, after "METHOD" insert -- FOR --

Title Page of Patent, Column 2, Item (74), Line 1, delete "Frim" and insert -- Firm --

Column 1, Line 3, after "METHOD" insert -- FOR --

Column 18, Line 40, Claim 6, after "Zr;" insert -- less than 0.4% of Ti, --

Column 19, Line 3, Claim 11, delete "0.76%" and insert -- 0.76 --

Column 19, Line 6, Claim 12, "(%Mo = 0.5%W)" should read -- (%Mo + 0.5%W) --

Column 20, Line 2, Claim 14, after "Zr;" insert -- less than 0.4% of Ti, --

Signed and Sealed this
Sixth Day of March, 2012

David J. Kappos

David J. Kappos
*Director of the United States Patent and Trademark Office*